US008141408B2

(12) United States Patent
McCauley

(10) Patent No.: US 8,141,408 B2
(45) Date of Patent: Mar. 27, 2012

(54) HOLDER FOR PRESS DIES

(76) Inventor: Kirk Allen McCauley, Uniontown, OH (US)

( * ) Notice: Subject to any disclaimer, the term of this patent is extended or adjusted under 35 U.S.C. 154(b) by 609 days.

(21) Appl. No.: 12/328,526

(22) Filed: Dec. 4, 2008

(65) Prior Publication Data

US 2009/0139296 A1 Jun. 4, 2009

Related U.S. Application Data

(60) Provisional application No. 60/992,144, filed on Dec. 4, 2007.

(51) Int. Cl.
*B21J 13/08* (2006.01)

(52) U.S. Cl. ..... 72/481.1; 72/461; 72/466.8; 72/481.9; 72/482.93

(58) Field of Classification Search ..... 72/481.1, 72/481.6, 481.9, 482.2, 482.5, 482.6, 482.92, 72/482.93, 482.94, 46, 466.8, 482.942
See application file for complete search history.

(56) References Cited

U.S. PATENT DOCUMENTS

| | | | | |
|---|---|---|---|---|
| 3,823,486 | A * | 7/1974 | Bhat et al. | 33/366.13 |
| 4,680,955 | A * | 7/1987 | Sakamoto | 72/389.4 |
| 5,168,745 | A * | 12/1992 | Miyagawa et al. | 72/446 |
| 5,410,904 | A * | 5/1995 | Hirata et al. | 72/446 |
| 5,794,486 | A * | 8/1998 | Sugimoto et al. | 72/481.3 |
| 6,021,659 | A * | 2/2000 | Russell | 72/481.7 |
| 6,024,681 | A * | 2/2000 | Latten et al. | 72/446 |
| 6,843,760 | B2 * | 1/2005 | Akami et al. | 72/481.6 |
| 7,308,817 | B2 * | 12/2007 | Shimota et al. | 72/482.1 |
| 7,634,935 | B2 * | 12/2009 | Mazzocchi | 72/482.92 |

* cited by examiner

*Primary Examiner* — David Jones
(74) *Attorney, Agent, or Firm* — Zollinger & Burleson Ltd

(57) ABSTRACT

A press die holder holds an upper die with its receiving structure above the die body. This configuration allows the die to be removed from the holder in the configuration in which it will be loaded into the press. The operator does not have to flip the die over before loading the die into the press. The holder may be configured to hold a lower die with its receiving structure disposed below the die body. This also prevents the lower die from being flipped over when it is removed from the holder and loaded into the press. One configuration of the invention provides a holder having a pair of fingers that engage the pair of continuous grooves defined by the receiving structure of the die so that the die hangs from the fingers.

20 Claims, 5 Drawing Sheets

HOLDER FOR PRESS DIES

CROSS REFERENCE TO RELATED APPLICATIONS

This application claims the benefit of U.S. Provisional Patent Application Ser. No. 60/992,144 filed Dec. 4, 2007; the disclosures of which are incorporated herein by reference.

BACKGROUND OF THE INVENTION

1. Technical Field

The present invention generally relates to tool holders and, more particularly, to holders for elongated press dies used with metal bending presses.

2. Background Information

Metal bending presses may be used to bend sheets of metal between upper and lower dies. A variety of presses are known in the art. Each has a pair of die holders or beams for holding the upper and lower dies in working positions. Different presses have different mechanisms for holding the dies.

FIGS. 1A, 1B, 2A, and 2B depict exemplary dies 2 and 4 (or portions of dies) known in the art. Dies 2 and 4 are provided in a variety of cross sectional shapes and lengths but each includes a working end and a receiving structure 6 that is held by the beam of the press. Die 2 is an upper die while dies 4 are lower dies. Each receiving structure 6 of dies 2 and 4 of FIGS. 1A, 1B, and 2B defines a pair of continuous grooves 8 that cooperate with the press to position and hold dies 2 and 4 in the press.

Dies 2 and 4 are hardened steel and relatively heavy. Long dies are especially unwieldy and can be difficult to load into the press by a single operator. Each die 2 and 4 is expensive and, although manufactured from hardened steel, is susceptible to nicks, dings, or scratches that can ruin the die.

Dies 2 and 4 are currently stored lying sideways on a table or in a drawer. Storing dies in these manners and in these locations is inconvenient for the operator and increases the risk of damage to the dies. One die manufacturer provides a cabinet wherein the dies are stored with their receiving structures disposed in slots formed in the bottom of drawers. The upper dies are thus stored upside down. Although this type of a cabinet keeps the dies safe and out of the way, the upper dies must be flipped over when loaded and unloaded. This increases the risk of damaging a die by dropping it on the floor or by hitting it against something.

BRIEF SUMMARY OF THE INVENTION

The invention provides a press die holder that holds an upper die with its receiving structure above the die body. This configuration allows the die to be removed from the holder in the configuration in which it will be loaded into the press. The operator thus does not have to flip the die over before loading the die into the press. The holder may be configured to hold a lower die with its receiving structure disposed below the die body. This also prevents the lower die from being flipped over when it is removed from the holder and loaded into the press.

One configuration of the invention provides a holder having a pair of fingers that engage the pair of continuous grooves defined by the receiving structure of the upper die so that the die hangs from the fingers. The portions of the fingers that engage the dies may be made from a material that slides along the die with little friction.

One configuration of the invention provides a holder having a plurality of fingers that engage the continuous grooves with at least two fingers disposed in each groove. In an exemplary embodiment, the fingers slidingly engage the grooves. In another exemplary embodiment, the fingers rollingly engage the grooves. The rolling fingers may be in the form of ball bearings that directly engage the grooves. The rolling fingers may be in the form of wheels rotatably supported on headed pins by bearings.

Any of the holder configurations summarized above may be combined with a pair of fingers or pair of tracks over which the lower dies slide to be supported in an upright configuration. The upper and lower dies may be disposed in an alternating configuration.

Any of the holder configurations summarized above may be combined with a supporting frame that allows the height of the dies to be adjusted so that the die being removed from or loaded into the holder is substantially the same height as the beam of the press. This minimizes the amount of die movement required by the operator.

Any of the holder configurations summarized above may be combined with a supporting frame that pivots about a vertical axis so that a die carried by the holder may be substantially aligned with the beam where it is to be installed. The pivoting supporting frame may be disposed adjacent a press and may be connectable to a press.

BRIEF DESCRIPTION OF THE SEVERAL VIEWS OF THE DRAWINGS

Similar numbers refer to similar parts throughout the specification.

DETAILED DESCRIPTION OF THE INVENTION

The invention provides different holder embodiments that allow upper and lower dies to be safely and conveniently stored. The holders may be arranged on a frame to form a die rack. The holders of the die rack may be configured to orient the dies in the orientation in which they will be used in the press. The rack thus allows the worker to move dies from the rack to the press without reorienting the dies. In one configuration, a plurality of holders are arranged in a movable frame that allows the position of the holders to be adjusted. The holders and frames of the invention minimize the likelihood that dies will be damaged during the loading of dies into the presses and during the unloading of the dies from the presses. The holders and frames of the invention also keep the dies safe while they are in storage.

Figure 2A:
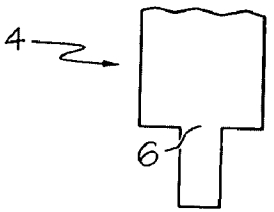
FIG. 2A PRIOR ART
FIG. 2A is an end view of the lower portion of one type of a prior art bottom die.
Figure 2B:
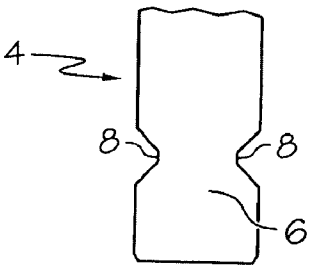
FIG. 2B PRIOR ART
FIG. 2B is an end view of the lower portion of another type of a prior art bottom die.
Figure 1A:
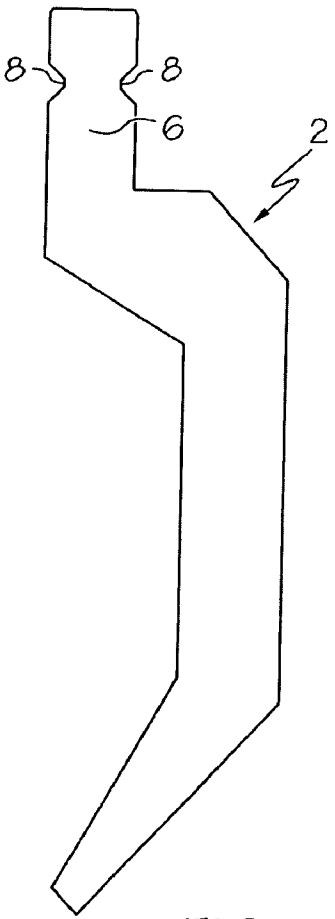
FIG. 1A PRIOR ART
FIG. 1A is an end view of an exemplary prior art upper die used that may be used with a press.
Figure 1B:
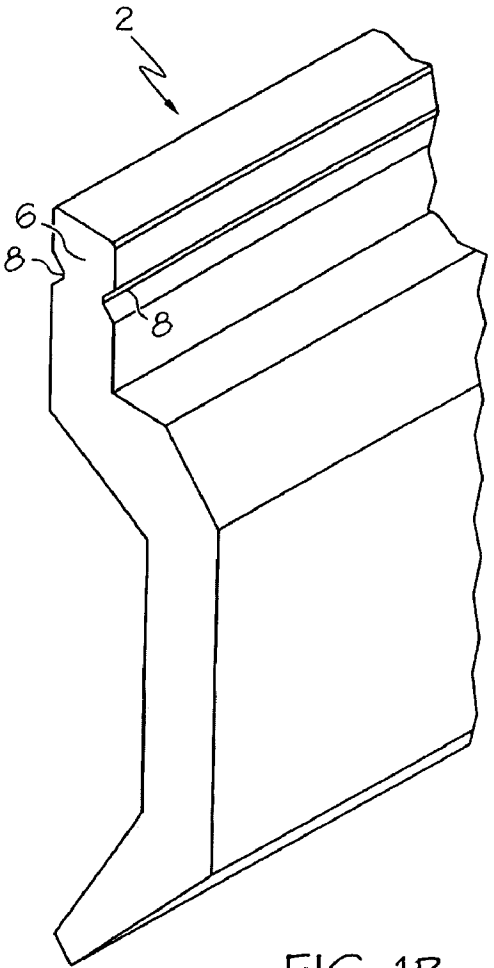
FIG. 1B PRIOR ART
FIG. 1B is a perspective view of the die of FIG. A.
Figure 3A:
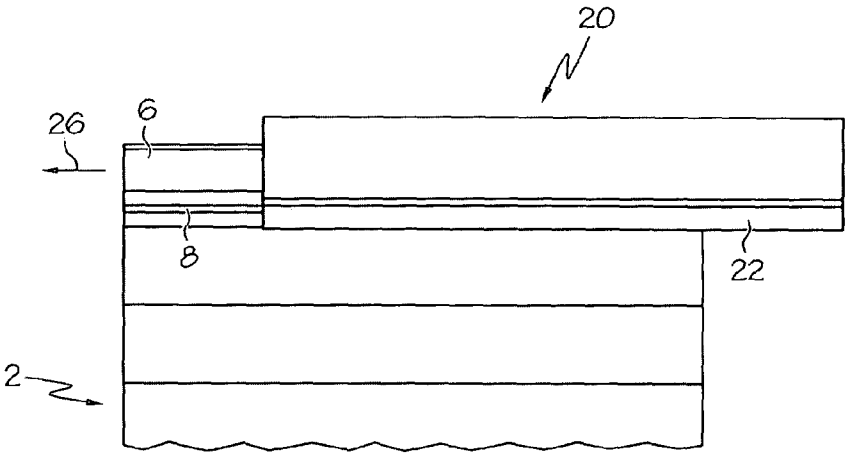
FIG. 3A is a side view of one holder configuration.
Figure 3B:
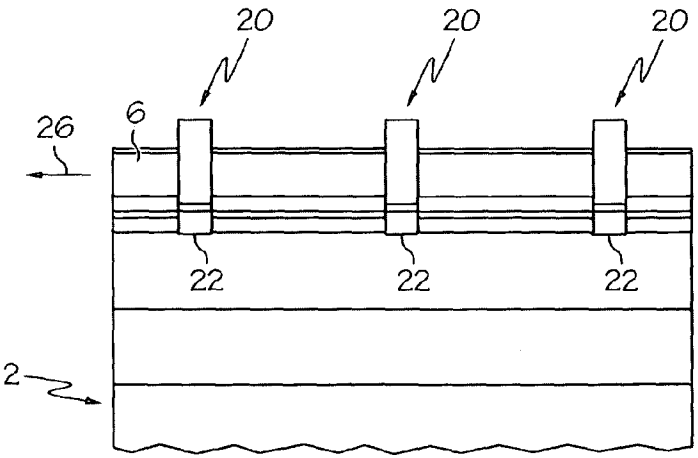
FIG. 3B is a side view of another holder configuration.
Figure 3:
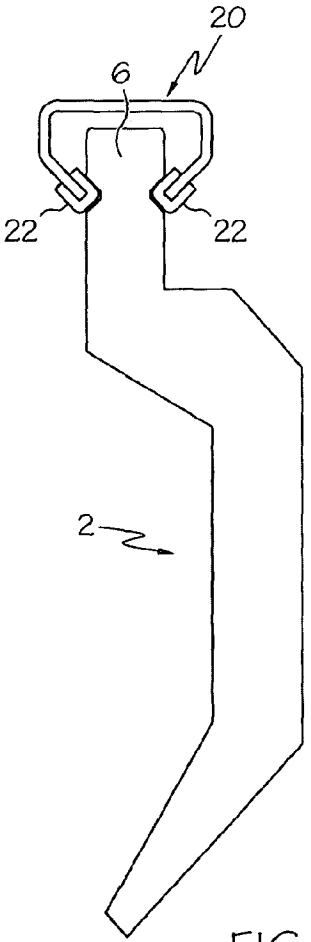
FIG. 3 is an end view of the upper die of FIG. 1A held by a first type of holder fingers that slidingly engage the die.

FIG. 3 depicts an exemplary holder 20 having at least one pair of opposed holder fingers 22 that slidingly engage grooves 8 to support die 2 in a hanging configuration. Holder 20 includes a pair of arms 24 that support fingers 22. Arms 24 may be fabricated from one of the finger materials described below. Die 2 is removed from holder 20 by sliding die 2 out laterally as indicated by arrow 26 in FIGS. 3A and 3B. In the exemplary configuration of holder 20 depicted in FIGS. 3, 3A, 3B, and 3D, arms 24 extend substantially perpendicular from a common base 27 and then toward each other at an angle (about 45 degrees with respect to base 27).

Figure 3D:
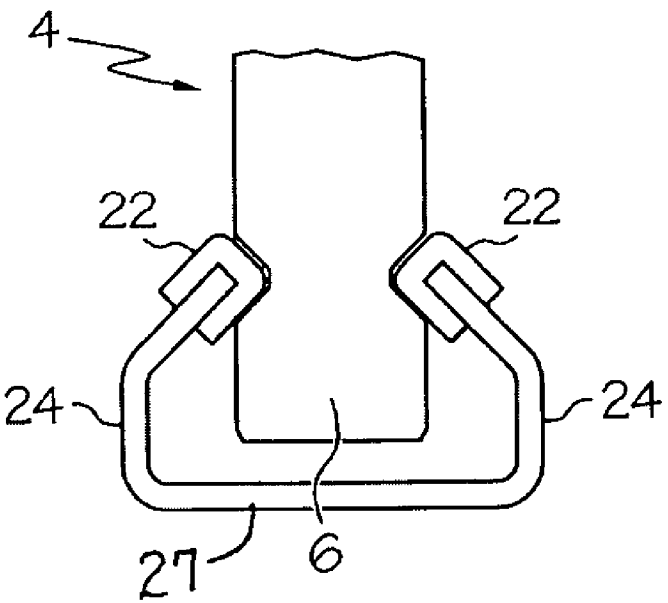
FIG. 3D is an end view of the lower die of FIG. 2B held in a first type of holder fingers that slidingly engage the die.
Figure 3C:
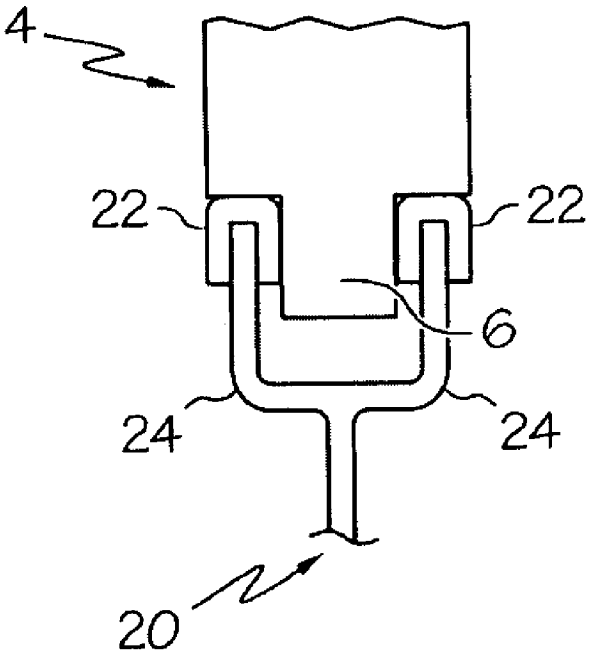
FIG. 3C is an end view of the lower die of FIG. 2A held in a first type of holder fingers that slidingly engage the die.

Fingers 22 may be defined as the integral tips of the arms that engage grooves 8. Fingers 22 thus may be formed from the same material as arms 24 and may be the same cross sectional size as arms 24. Fingers 22 also may be formed from a material different from arms 24 and be disposed over the inner ends of arms 24 as shown in FIGS. 3C and 3D. Fingers 22 may be formed from a nylon, a hard plastic material, a metal softer than the metal used to form dies 2, a paper-based material, a cloth, or a felt material. Fingers 22 may be softer than the steel of the die so that fingers 22 will not scratch grooves 8. The inner portions of the fingers 22 are spaced apart a first distance that is less than the thickness of receiving structure 6 so that die 2 will hang from fingers 22 by receiving structure 6. The first distance is larger than the space between grooves 8 so that die 2 may slide between fingers 22.

As shown in FIGS. 3 and 3D, fingers 22 may be rectangular in shape so that they will substantially fill grooves 8 when arms 24 are angled toward each other. In another embodiment, fingers 22 may be triangular with arms 24 disposed parallel to base 27 so that the tips of the triangular fingers 22 will be disposed in grooves 8.

FIGS. 3C and 3D depict holders 20 for lower dies 4. In FIG. 3C, arms 24 are disposed straight up so that fingers 22 will engage the bottom of die 4 on either side of receiving structure 6. Die 4 may thus slide on fingers 22. In FIG. 3D, arms 24 are angled toward each other as described above so that fingers 22 engage grooves 8 and die 4 rests on fingers 22.

FIG. 3A depicts an elongated holder 20 with elongated fingers 22 while FIG. 3B depicts a plurality of spaced holders 20. The configuration of FIG. 3A is easier to load because the ends of dies 2 and 4 only need to be aligned with holders 20 once.

Figure 4A:
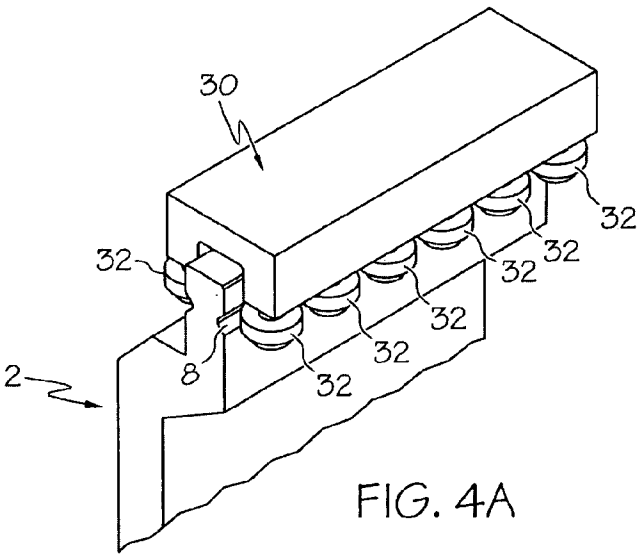
FIG. 4A is a partial perspective view of the holder of FIG. 4.
Figure 4B:
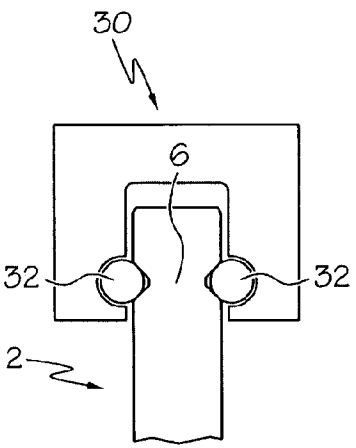
FIG. 4B an end view of the upper die of FIG. 1A held by a third type of holder fingers that rollingly engage the die.
Figure 4:
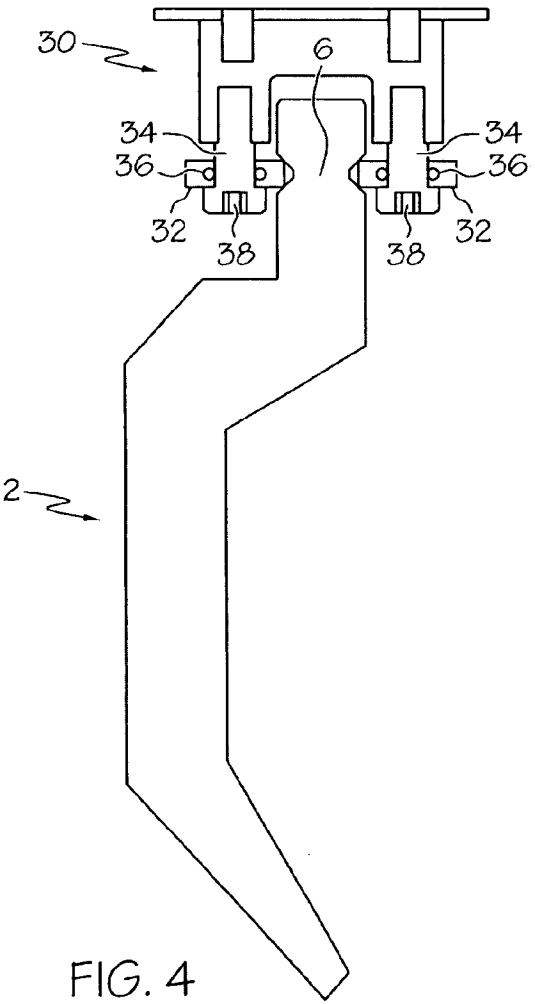
FIG. 4 is an end view of the upper die of FIG. 1A held by a second type of holder fingers that rollingly engage the die.

FIGS. 4, 4A, and 4B depict another exemplary embodiment of holder 20 wherein die 2 is rollingly supported by the fingers. In FIGS. 4 and 4A, the fingers that support the die are in the form of rolling finger wheels 32 are rotatably supported from pin arms 34 by bearings 36. Each pin arm 34 has a head 38 that supports bearings 36 and wheels 32. Wheels 32 are softer than the steel of die 2 so that grooves 8 are not damaged when die 2 is hung by wheels 32.

In the configuration of FIG. 4B, the fingers are in the form of bearings 32 that directly engage grooves 8 to support the die 2.

The rolling embodiments of the FIGS. 4 and 4B allow dies 2 to be easily rolled in and out of holders 30.

In each of the embodiments described above, a lock pin may be inserted through a portion of holder 20 or 30 to prevent dies 2 or 4 from unintentionally sliding or rolling out of holder 20 or 30.

Figure 5:
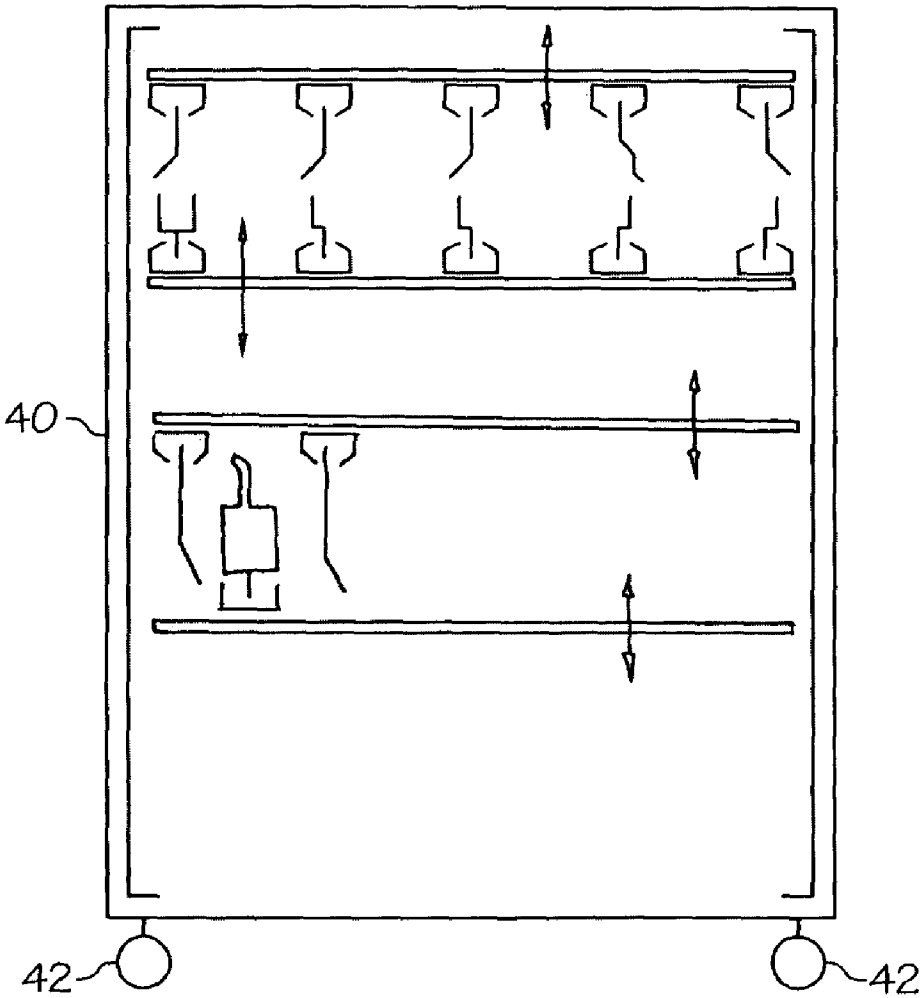
FIG. 5 is a front view of a die rack that includes a plurality of holder fingers.

A plurality of holders 20 and 30 may be combined on a frame 40 as shown schematically in FIG. 5 to form a rack. Frame 40 allows the height of holders 20 and 30 to be readily adjusted so that dies 2 and 4 may be set to the same level as they are used in the press. This allows the operator to move the dies back and forth between frame 40 and the press at the same height. Frame 40 may be carried on wheels 42. Holders 20 and 30 may be arranged in an alternating manner so that an upper die 2 will hang down between a pair of lower dies 4.

Frame 40 may be combined with a press in a pivoting manner to allow the dies to be stored next to the press in an accessible manner. Frame 40 may be pivoted out to a loading and unloading position wherein the dies may be substantially aligned with the machine to minimize the handling of the dies by the workers.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A holder for supporting and storing elongated dies used in a metal press when the elongated dies are not being using in the metal press; each of the elongated dies having a receiving structure that defines a pair of grooves; the receiving structure having a thickness and defining a distance between the inner portions of the grooves; the holder comprising:

a pair of opposed non-metal holder fingers having inner portions; the inner portions of the opposed non-metal holder fingers being spaced apart a first distance that is less than the thickness of the receiving structure so that the die will hang from the holder fingers by the grooves defined by the receiving structure of the die; and the non-metal holder fingers allowing the die to slide along the fingers.

2. The holder of claim 1, wherein the holder fingers are connected to a common frame.

3. The holder of claim 2, wherein the common frame includes a base and a pair of arms; each arm supporting one of the holder fingers.

4. The holder of claim 3, wherein the arms include a first portion disposed substantially perpendicular to the base.

5. A holder for supporting and storing elongated dies used in a metal press when the elongated dies are not being using in the metal press; each of the elongated dies having a receiving structure that defines a pair of grooves; the receiving structure having a thickness and defining a distance between the inner portions of the grooves; the holder comprising:

a pair of opposed holder fingers having inner portions; the inner portions of the opposed holder fingers being spaced apart a first distance that is less than the thickness of the receiving structure so that the die will hang from the holder fingers by the grooves defined by the receiving structure of the die;

the holder fingers connected to a common frame;

the common frame including a base and a pair of arms; each arm supporting one of the holder fingers;

the arms including a first portion disposed substantially perpendicular to the base; and the arms including a second portion disposed at an acute angle with respect to the base; the fingers connected to the second portion.

6. The holder of claim 5, wherein the fingers are angled toward each other.

7. The holder of claim 6, wherein the fingers are rectangular in cross section; each of the fingers having an inwardly disposed corner; the inwardly disposed corners being aligned.

8. The holder of claim 5, wherein the fingers are elongated.

9. A holder for supporting elongated dies used in a metal press when the elongated dies are not being using in the metal press; each of the elongated dies having a receiving structure that defines a pair of grooves; the receiving structure having a thickness and defining a distance between the inner portions of the grooves; the holder comprising:

a pair of opposed holder fingers having inner portions; the inner portions of the opposed holder fingers being spaced apart a first distance that is less than the thickness of the receiving structure so that the die will hang from the holder fingers by the grooves defined by the receiving structure of the die; and the fingers including rollers adapted to rollingly support the die.

10. A die storage rack for storing upper and lower press dies when the dies are not being using in a metal press; each of the upper dies having a receiving structure that defines a pair of grooves; the receiving structure having a thickness and defining a distance between the inner portions of the grooves the rack comprising:

a frame;

a plurality of upper die holders carried by the frame; each of the upper die holders having a pair of fingers spaced apart a first distance less than the thickness of the receiving structure and greater than the distance between the inner portions of the grooves; the fingers being adapted to slidingly engage the grooves to hold the upper press die;

an upper press die carried by one of the upper die holders with the receiving structure of the upper press die disposed between the fingers and above the working end of the upper press die;

a plurality of lower die holders carried by the frame; and wherein the fingers are non-metal.

11. A die storage rack for storing upper and lower press dies when the dies are not being using in a metal press; each of the upper dies having a receiving structure that defines a pair of grooves; the receiving structure having a thickness and defining a distance between the inner portions of the grooves the rack comprising:

a frame;

a plurality of upper die holders carried by the frame; each of the upper die holders having a pair of fingers spaced apart a first distance less than the thickness of the receiving structure and greater than the distance between the inner portions of the grooves; the fingers being adapted to slidingly engage the grooves to hold the upper press die;

an upper press die carried by one of the upper die holders with the receiving structure of the upper press die disposed between the fingers and above the working end of the upper press die;

a plurality of lower die holders carried by the frame; and wherein the upper die holders alternate with the lower die holders such the upper dies overlap the lower dies when the upper and lower dies are stored in the rack.

12. The die rack of claim 11, further comprising a lower press die carried by one of the lower die holders with the receiving structure of the lower press die disposed between the fingers and below the working end of the lower press die.

13. A die storage rack for storing upper and lower press dies when the dies are not being using in a metal press; each of the upper dies having a receiving structure that defines a pair of grooves; the receiving structure having a thickness and defining a distance between the inner portions of the grooves the rack comprising:

a frame;

a plurality of upper die holders carried by the frame; each of the upper die holders having a pair of fingers spaced apart a first distance less than the thickness of the receiving structure and greater than the distance between the inner portions of the grooves; the fingers being adapted to slidingly engage the grooves to hold the upper press die;

an upper press die carried by one of the upper die holders with the receiving structure of the upper press die disposed between the fingers and above the working end of the upper press die;

a plurality of lower die holders carried by the frame; and wherein the frame allows the height of the holders to be vertically adjusted.

14. The die rack of claim 13, wherein the position of one finger is fixed with respect to the other finger.

15. The die rack of claim 14, wherein the fingers are disposed in the grooves of the receiving structure.

16. The holder of claim 15, wherein the fingers are angled toward each other.

17. The holder of claim 16, wherein the fingers are rectangular in cross section; each of the fingers having an inwardly disposed corner; the inwardly disposed corners being aligned.

18. A die storage rack for storing upper and lower press dies when the press dies are not being using in a metal press; each of the press dies having a receiving structure that is used to support the press dies in the die storage rack; the die storage rack comprising:

a frame;

a plurality of upper die holders carried by the frame; each of the upper die holders having a pair of spaced fingers adapted to slidingly engage the receiving structure of an upper die to hold the upper press die;

a plurality of lower die holders carried by the frame; each of the lower die holders having a pair of spaced fingers adapted to slidingly engage the receiving structure of a lower die to hold the lower press die;

the spaced fingers of the upper and lower die holders being non-metal; and the upper die holders alternating with the lower die holders such the upper press dies overlap the lower press dies when the upper and lower dies are stored in the rack.

19. The holder of claim 18, wherein the frame allows the height of the holders to be vertically adjusted.

20. The holder of claim 18, wherein the fingers include rollers adapted to rollingly support the die.

* * * * *